US012241367B2

(12) United States Patent
Hahn-Jose et al.

(10) Patent No.: US 12,241,367 B2
(45) Date of Patent: Mar. 4, 2025

(54) INFORMATION TRANSFER SYSTEM

(71) Applicant: YTA B.V., Breda (NL)

(72) Inventors: Thomas Hahn-Jose, Saarland (DE); Junying Chang, Breda (NL)

(73) Assignee: YTA B.V., Breda (NL)

( * ) Notice: Subject to any disclaimer, the term of this patent is extended or adjusted under 35 U.S.C. 154(b) by 0 days.

(21) Appl. No.: 17/764,790

(22) PCT Filed: Oct. 13, 2020

(86) PCT No.: PCT/EP2020/078758
§ 371 (c)(1),
(2) Date: Mar. 29, 2022

(87) PCT Pub. No.: WO2021/074136
PCT Pub. Date: Apr. 22, 2021

(65) Prior Publication Data

US 2022/0364461 A1 Nov. 17, 2022

(30) Foreign Application Priority Data

Oct. 14, 2019 (GB) ..... 1914843

(51) Int. Cl.
*E21B 47/16* (2006.01)
*E21B 41/00* (2006.01)
(Continued)

(52) U.S. Cl.
CPC ..... *E21B 47/16* (2013.01); *E21B 41/0085* (2013.01); *E21B 43/119* (2013.01); *E21B 47/06* (2013.01)

(58) Field of Classification Search
CPC ..... E21B 47/16
See application file for complete search history.

(56) References Cited

U.S. PATENT DOCUMENTS 3,900,827 A * 8/1975 Lamel ..... G01V 11/002 175/50
5,159,226 A 10/1992 Montgomery
(Continued)

FOREIGN PATENT DOCUMENTS

EP 1887181 A1 2/2008

OTHER PUBLICATIONS

GB Combined Search and Examination Report, Application No. GB1914843.6, Applicant: YTA B.V., Date of Report: Jul. 8, 2020.
(Continued)

*Primary Examiner* — Robert E Fuller
(74) *Attorney, Agent, or Firm* — Reising Ethington P.C.

(57) ABSTRACT

A wireless downhole information transfer system is adapted to operate in wells (well bores), and in particular in wells for the Oil & Natural Gas and Geothermal Industry. The information transfer system comprises an elongated tubing (completion) having several tubing sections comprising a first and a last end tubing section, an information signal generator placed at or near the first tubing section of the elongated tubing. The information signal generator is designed as a torsional wave generator for transmission of a torsional wave information signal along the elongated tubing, and an information signal receiver arranged at or near the last tubing section of the elongated tubing, wherein the elongated tubing between the signal generator and the signal receiver constitutes a carrier for transmission of the information signal between the signal generator and the signal receiver.

16 Claims, 7 Drawing Sheets

(51) Int. Cl.
*E21B 43/119* (2006.01)
*E21B 47/06* (2012.01)

(56) References Cited

U.S. PATENT DOCUMENTS

| | | | | |
|---|---|---|---|---|
| 5,166,908 | A * | 11/1992 | Montgomery | H10N 30/505 367/165 |
| 2004/0035608 | A1 * | 2/2004 | Meehan | E21B 47/16 166/254.2 |
| 2016/0265349 | A1 | 9/2016 | Saulnier et al. | |
| 2017/0032653 | A1 * | 2/2017 | Crawford | E21B 47/16 |

OTHER PUBLICATIONS

GB Examination Report, Application No. GB1914843.6, Applicant: YTA B.V., Date of Report: Apr. 21, 2021.
PCT Int. Search Report, Int. Serial No. PCT/EP2020/078758, Int. Filing Date: Oct. 13, 2020, Applicant: YTA B.V., Mail Date: Jan. 26, 2021.
PCT Int. Written Opinion, Int. Serial No. PCT/EP2020/078758, Int. Filing Date: Oct. 13, 2020, Applicant: YTA B.V.
PCT International Preliminary Report on Patentability, Int. Application No. PCT/EP2020/078758, Int. Filing Date: Oct. 13, 2020, Applicant: YTA B.V., Date: Apr. 28, 2022.

* cited by examiner

INFORMATION TRANSFER SYSTEM

TECHNICAL FIELD

The present disclosure is related to a data transmission system especially for wells (well bores), and in particular for wells in the Oil & Natural Gas and Geothermal Industry.

BACKGROUND AND SUMMARY OF THE PRESENT DISCLOSURE

Wells are used in the petroleum and natural gas industry to produce hydrocarbons (production well) from a reservoir or to inject fluids (injection well) into a reservoir, for example water, $CO_2$, natural gas, steam, surfactants, polymers and/or nitrogen. Typically, such fluids are injected to increase the hydrocarbon recovery from reservoirs by maintaining reservoir pressure, or by improving hydrocarbon displacement process or by decreasing the residual hydrocarbon saturation in the reservoir. In the geothermal industry a hot fluid such as hot water is produced to surface e.g. from deep aquifers to collect heat for heating purposes, such as for houses in cities and villages. Subsequently the "cooled" water is reinjected into the aquifer. Lately, $CO_2$ injection has been started with the goal to store $CO_2$ in depleted hydrocarbon reservoirs to reduce the concentration of $CO_2$ in the atmosphere in order to combat $CO_2$ emission and global warming.

Typically, a well has one well bore which is lined with steel pipes, generally referred to as casing or liner. The casing or liner is cemented in place in the overburden section to provide zone isolation in order to avoid contamination of shallow aquifers by deep reservoir fluids (i.e. oil/brines) and to reduce the risk of unwanted evacuation of fluids from the overburden/shallow reservoirs. For the well completion for the reservoir section several options can be used. The most common completions are open hole completions and cased hole completions. In the open hole completion the reservoir section is not sealed off by casing and cement. In cased hole completion the reservoir section is sealed off by casing and cement. Most open hole and cased hole completions contain also a tubing with a packer (occasionally several packers are run to obtain selectivity within the reservoir) for sealing off sections of the annulus between the tubing and the steel liner. In cased hole completions access to the reservoir is gained by perforating through the casing/liner and cement. Open hole completions are often completed with a perforated (pre-drilled holes) liner to access the reservoir. It should be noted that the holes can also be made at a later stage of the well life.

When the well has been completed for production or injection, the well can be opened up to become active. When the well is opened up, fluid movement will start in and out of the wellbore. In order to gain understanding and control of the events and to observe flow dynamics in the wellbore, communication with objects (sensors or devices) in the wellbore will be useful, in particular when no cables for the data gathering would be required. For example, when perforating the well e.g. for commencing production, explosives need to be triggered when they have arrived at the position where to perforate the walls of the wellbore, e.g. the casing and cement sheath. This is a delicate operation, as an error in information delivery could easily harm the well severely (i.e. water bearing formation perforated instead of oil-bearing formation). The trigger shall therefore be transmitted to the igniter correctly and in a safe manner. The downhole igniter could give a response that could be transferred to surface when there is communication with systems at surface. Therefore a two-way communication system would be desirable. Other information that could be transported real time from downhole through the well to surface could include sensor information from downhole sensors and/or devices, such as

- Pressure and temperature data
- Flow (oil, water and gas)rate data
- Fluid composition data
- Reservoir data (e.g. oil saturation)
- Integrity data (e.g. cement bond log)
- Command data for downhole equipment (e.g. downhole valves/chokes, igniters)
- Response data from the downhole on the commands from surface (e.g. confirmation that guns have been fired)

As the total length from the reservoir to surface (top end of the well bore) may sum up to several hundred or even several thousand meters, sending or retrieving (without use of cables) such data or information, e.g. to an extraction facility at said access, is difficult and subject to continued development. The depth as well as the total length of the wells has increased over the past decades. Also the number of long deviated (extended reach) wells keeps increasing, which makes it even more difficult to establish any communication or data exchange between the wellbore and surface.

Thus, an object of the present disclosure is to provide a system for establishing an information exchange, which is a communication connection or data exchange over a transmission channel especially in well bore environments.

Another object of the present disclosure is to allow for wireless communication between two ends of the completion (e.g., an elongated tubing), for example to transmit the signal for initiating detonation of perforating guns.

Another object of the present disclosure is to improve reliability, accuracy and quality of the information exchange in real time and continuously between two ends of the completion (e.g. elongated tubing).

Yet another aspect of the object of the present disclosure is to improve the limitations mentioned above.

Another object of the present disclosure is to provide a system and/or a method for transmission of information through a transmission channel with improved speed and/or data density.

A wireless downhole information transfer system is presented which in principal is adapted to operate in any installation where a completion (e.g. elongated tubing) is provided. The information transfer system is preferably being adapted to operate in a well bore.

For example, well bores can comprise difficult environmental conditions such as a pressure in the range up to 60 MPa or a temperature which could rise up to a range of 500 Kelvin. Since in future the depth of the wells will increase the encountered temperature and pressure in the wells could even be higher. Such a well bore can have open hole sections and/or cased hole sections, and it can comprise an angle with respect to a vector towards the centre of the earth and/or gravity. In other words, the well bore or at least sections of the well bore can have any orientation in an earth formation, including for example horizontal portions which may even be preferred and drilled intentionally depending on the type of well bore. The orientation may, as a matter of fact, partly even be oriented upwards. Such an upwards oriented well bore may be required, when a selected layer is drilled alongside (which contains natural resources, in particular containing hydrocarbons such as oil or gas) and the selected layer is not oriented perfectly horizontally, but deviates upwards or downwards for a certain distance.

The well bore fluid can vary widely. The wellbore could consist of mud (drilling fluid), brine (completion fluid), injection fluids such as steam, $CO_2$ or nitrogen or fluids from the reservoir, such as water, oil and/or gas. These fluids may contain solids and deposits, such as sand particles, clay particles, scale deposits salts, barites, asphaltenes and polymers.

The information transfer system comprises a completion, which in most cases consists of an elongated tubing. The elongated tubing has several sections comprising a first and a last end section. In other words, the tubing is provided in pipe sections which are connected to each other (e.g. screwed into one another or welded to each other) to provide the overall elongated tubing. Each pipe section thus is connected with its neighbouring pipe section. As a matter of fact, it has been found out that the quality of each connection between two of such pipe sections can be quite critical regarding any propagation of signals along the tubing. But even when each connection between two of such pipe sections is done with every caution, typically at least the pipe outer diameter or its wall thickness changes in the region of any connection to the neighbouring pipe section. For example, if two pipe sections are screwed into each other, typically the overall wall thickness where the threaded portion is provided, and where two pipe sections overlap each other in the screw threads, is different with respect to the overall wall thickness in a non-threaded portion of the tubing. Such variations of material diameters and/or connection between neighbouring pipe sections make it difficult in practice to even propagate any type of signals along such an elongated tubing comprising several pipe sections. For example, in a typical well the elongated tubing may consist of 100 to 500 pipe sections. In long reach wells the completion may have even more pipe sections.

The information transfer system comprises further an information signal generator arranged at or near the first end section of the elongated tubing. In other words, at a first end of the elongated tubing there is a signal generator which shall impose an information signal on the elongated tubing. The signal generator may be installed directly at the elongated tubing, e.g. directly at the first end section circumferential around the first end section. The signal generator may also be installed at an overhead section of the elongated tubing, such as a wellhead and or Christmas (X-tree) which is nearly always present above the well bore. So, the signal generator is situated at or near the first end pipe section and preferably in direct contact with it.

The signal generator has a torsional wave generator for transmission of a torsional wave information signal along the elongated tubing. The information signal is provided as a torsional wave signal, where the elongated tubing performs a torsional distortion movement in order to propagate the information signal along the elongation axis of the elongated tubing. The elongated tubing thus constitutes the information signal propagation path for the torsional wave information signal.

The information transfer system comprises further an information signal receiver. The information signal receiver is installed at or near the last end section (bottom) of the elongated tubing. For example, when the elongated tubing comprises 200 pipe sections, the receiver could be installed within the last 10 or 20 of the pipe sections. The receiver can then receive the information signal, retrieve its information content and send any command or pass it to any functional unit situated close by, such as an igniter for the perforating gun for perforating the well.

The information signal can be provided in the form of a trigger and/or a short pulse signal. The information content would be rather low, but in the case of an activation signal such as for a perforating gun, this signal can anyhow be sufficient. The information signal can also be coded to provide information to distinguishable receivers. For example, the information signal can contain an identification signal portion such as the beginning of the signal or the end, where the receiver is capable to recognize a specific signal form as that that specific information signal is dedicated to it. For example, by means of such a signal coding several receivers can be installed at the same elongated tubing, and even when some or all of the receivers receive the same signal, the dedicated receiver identifies respective information signals meant for it and reads out the respective information.

The information signal can also be coded to provide distinguishable information. Any coding such as amplitude modulation can be used.

The elongated tubing extends between its first and last end sections, and thus, extends between the signal generator installed at or near the first end section and the receiver installed at or near the last end section. This elongated tubing constitutes part of the information signal transfer system, as it constitutes the carrier for transmission of the information between the signal generator and the signal receiver. The elongated tubing performs a torsional flection (or several) and by means of its material cohesion the torsional wave is passed through and along the material of the elongated tubing from the signal generator to the signal receiver.

The information signal generator can preferably be designed as a transceiver, which is, that the generator can transmit as well as receive an information signal e.g. from the signal receiver. In the same way, also the information signal receiver can be designed as a transceiver. If both the signal generator and the signal receiver are designed as transceivers, a bi-directional information exchange between the signal generator and the signal receiver may be established.

The information signal can be provided in form of a resonant frequency adapted to the properties of the elongated tubing, and/or adapted to the total distance between the information signal generator and the information signal receiver.

Further, the system may comprise one or more further information signal receivers arranged along or near the elongated tubing. So, for example to each function device installed at or in the elongated tubing, a signal receiver may be assigned.

The information signal generator comprises preferably at least one piezoelectric driver. The piezoelectric driver can convert an electric signal into a sound wave signal, and the other way around can convert a sound wave signal into an electrical signal. So, a piezoelectric driver may function as a transceiver.

The piezoelectric driver can comprise one or more piezoelectric discs stacked in a line. The overall signal amplitude can be improved by using several piezoelectric discs. The piezoelectric discs may, for example be driven in parallel in the meaning of sound generation and/or in series in the meaning of electrical wiring. Each piezoelectric disc may comprise a thickness in the range of 1 mm to 5 mm, where a thickness of around 2 mm or even thinner seems preferable.

The information signal generator can also comprise two or more piezoelectric drivers, the two or more piezoelectric driver arranged on opposing sides of an elongation axis of the tubing and/or arranged symmetrically or equiangular around the elongation axis of the tubing. So, for example, each soundwave generator or each piezoelectric driver is arranged perpendicularly with respect to the elongation axis of the tubing, but does not necessarily need to be arranged directing towards the elongated tubing. But in one example, the soundwave generator is arranged such that it is directed towards the elongated tubing, and perpendicular to the elongation axis of the tubing.

The information signal generator can alternatively or cumulatively comprise one or more magnetostrictive drivers, such as discs, operating quite similar as the before-mentioned piezoelectric driver. Upon application of a magnetic alternating field each magnetostrictive driver, or each magnetostrictive disc, expands and contracts alternatingly, thus emitting a wave signal of selectable frequency.

For example in a comparatively low frequency region even a mechanical drive may be used to generate a wave signal of selectable frequency, such as by means of using an oscillating weight, and for example in a frequency region of 2 Hz to 1 kHz, such as in the region of 100 Hz±80 Hz or ±20 Hz.

The information signal may comprise a frequency in the range of 2 Hz to 20 kHz. The information signal may also comprise a frequency in the range higher or equal to 2 Hz, higher or equal to 500 Hz, higher or equal to 1 kHz, higher or equal to 2 kHz, or higher or equal to 5 kHz. At the same time, or independent therefrom, the information signal may also comprise a frequency in the range lower or equal to 25 kHz, lower or equal to 20 kHz, lower or equal to 15 kHz, lower or equal to 10 kHz, or lower or equal to 8 kHz. The frequency depends also on some properties of the elongated tubing, such as the material it consists of, the weight of the tubing, wall thickness and/or its overall length or the length between the signal generator and the signal receiver. In other words, the frequency of the information signal can be chosen in the before-mentioned ranges or limits and adapted to the elongated tubing along which the information signal shall propagate to transfer the information carried by the information signal. In this sense, for example, with a short or shorter elongated tubing and/or a shorter distance to the next signal repeater or signal receiver, a higher frequency can be chosen for the information signal, in order to e.g. transfer more information, e.g. to increase the data rate.

At least one repeater can be arranged between the information signal generator and the information signal receiver. Such a repeater can be designed similar to the signal receiver, so that it can be said that at least one of the information signal receivers is a repeater designed to pass the information signal to the next repeater and/or to the information signal receiver arranged at or near the end section of the elongated tubing. But for example, the repeater or the repeaters can be designed as transceivers, whereas the signal receiver does not necessarily have to have the capability of sending signals. However, in a setup where the signal receiver should also be capable of sending a signal, all units can be designed as transceivers. For example, when the receiver is designed as a transceiver, also such functions can be fulfilled by the receiver such as setting valves and reporting valve function or valve status, and also values can be transmitted such as temperature, pressure or fluid velocity of the wellbore fluid in the elongated tubing. The information transportation system might even be designed such, that the signal generator is situated down in the well and "reporting" fluid properties. The generator then is transmitting this information over the elongated tubing by means of torsional wave information signal to the signal receiver, which is installed on top of the well, e.g. at the wellhead or X-tree or at the last pipe section. The signal receiver receives the before-mentioned signals.

Each repeater is preferably designed to use a distinguishable coding. By this it may be assured, that when any receiver or repeater receives a signal from a sender which is not intended for the specific receiver or repeater that this may be recognized and the respective receiver or repeater can omit this signal. In other words, by means of a distinguishable coding of the torsional wave information signal the respective receiver or repeater may recognize the signal intended for it and read out this signal.

For example, for each 1500 meters or more of elongation of the elongated tubing an additional repeater can be used to amplify the information signal. However, it is intended to transmit the information signal without any repeater, if possible. Depending on the properties of the elongated tubing, also for each 1000 meters or more, or for each 500 meters or more, or for each 100 meters or more an additional repeater may be installed for signal amplification.

Signal recognition can be improved by means of autocorrelation, so that the receiver provides processing means designed to provide means for autocorrelation of the received information signal. For example, a predefined signal pattern can be stored in the receiver (e.g. in a storage means such as a memory) and the receiver can compare the stored signal pattern with the received signal. When the correlation between the stored signal and the received signal matches, the receiver receives the information. By this, the signal-to-noise ratio can be improved significantly.

The information transfer system preferably provides autotuning capability, wherein both the signal generator and the signal receiver are designed as transceivers and wherein a frequency range is tested and at least one resonance frequency is acknowledged, e.g. by the signal receiver or the signal generator.

For example, the information signal receiver is connected with one or more perforating units in a well bore, where the information signal comprises the firing signal for detonation of the firing unit (igniter) or for detonation of one or all of the firing units.

The elongated tubing, which is the propagation channel for the torsional wave information signal, is preferably made of metal, for example steel.

The (at least one) information signal receiver may additionally comprise an energy storage, for example a battery pack, in order to provide electric energy to the information signal receiver. From this battery pack the information signal receiver can be supplied with electrical energy, so that the signal receiver works autonomously.

The present disclosure includes also an information signal generator for use in a downhole information transfer system, for example such a one as depicted above. This information signal generator is designed for transmission of an information signal along an elongated tubing. For this, the signal generator comprises (at least one) a wave generator arranged perpendicularly or more or less perpendicularly with respect to the elongation axis of the elongated tubing for generation of the wave information, such as the torsional wave information. In other words, the wave generator comprises a direction of wave emission, where the direction of wave emission is oriented perpendicular or more or less perpendicular with respect to the elongation axis of the elongated tubing. The direction of wave emission is thus not along the elongated tubing and not directed in the direction of the tubing, but the wave is emitted in a transverse direction to the elongation axis of the tubing. Additionally, the wave generator may be positioned off-center, which is not in the center of the elongated tubing, but at or close to the side of the tubing, so that the wave is delivered tangentially to the elongated tubing.

For example, it might even be impossible to emit torsional waves when the wave generator is oriented along the elongation axis of the elongated tubing. In this, the wave generator should "twist" the elongated tubing in order to introduce a shear force on the tubing. The force impact thus should comprise a tangential component on the elongated tubing to force a shear strain of the tubing. But when the wave generator is oriented along the elongation axis of the elongated tubing such tangential component may be negligible. However, the information signal may be transmitted by means of the torsional wave signal, for example with regard to signal damping, further in particular due to the couplings in between the several elements of a typical elongated tubing.

The sound wave generator may comprise or consist of one or more piezo driver(s).

The signal generator is preferably arranged at or near a top section of the elongated tubing, for example, it may be arranged at an overhead portion of the elongated tubing, such as a wellhead and or X-tree.

Preferably, the signal generator comprises a circumferential portion, where the (at least one) sound wave generator is arranged on the circumferential portion, so that the sound wave generator exposes the circumferential portion with the (at least one) sound wave and the circumferential portion passes that (at least one) sound wave to the elongated tubing. The circumferential portion can be designed in such a way, that it encloses the elongated tubing, in other words, that it is circumferentially closed around the elongated tubing, or that it is ring-shaped and arranged around the elongated tubing. The circumferential portion thus may convert the (at least one) sound wave emitted by the sound wave generator into at least one torsional wave.

The circumferential portion preferably comprises an inner side directed, when installed, towards the elongated tubing. The outer side of the circumferential portion is directed away from the elongated tubing; for example, the sound wave generator is arranged on the outer side of the circumferential portion. Further, the circumferential portion can comprise a circumferential constriction on said inner side. By means of the constriction, the overall surface area of the circumferential portion being in contact with the elongated tubing can be reduced.

The circumferential portion can be mounted to the elongated tubing such as to comprise good surface contact, for example by means of an increased contact pressure of the circumferential portion against the elongated tubing in order to improve signal propagation from the sound wave generator to the elongated tubing.

The sound wave generator can comprise a stack of piezoelectric drivers, where each piezoelectric driver could be a piezoelectric disc. Then all the discs can be piled upon each other and connected in series, so that all piezos can contribute to the signal amplitude of the acoustic wave signal generated by the piezoelectric discs, and thus increase the amplitude of the information signal.

The sound wave generator comprises an end mass arranged on top of it. In other words, when the sound wave generator comprises the stack of piezo discs, on top of that stack the end mass is arranged, which again increases signal amplitude. In other words, the end mass is arranged in contact with the first or last piezo disc of the stack of piezo discs. For example, the end mass may comprise more or less the same diameter as the piezo discs. The end mass may be made of iron, or any other rather heavy weight, where of course material price may influence the selection of the respective material for the end mass.

The signal generator may comprise two sound wave generators arranged opposing each other. Preferably the two sound wave generators are arranged at the same position in respect to the longitudinal elongation direction of the tubing, but on opposite sides of said tubing. However, technically the two sound wave generators can also be situated in any angle with respect to each other, where the opposing arrangement seems to result in higher achievable signal amplitude and is preferred due to this.

The signal generator may comprise several sound wave generators (which is two or more) arranged equiangular to each other. In other words, the sound wave generators are preferably all arranged perpendicular to the elongation direction of the tubing, and around said tubing with respect to each other with an angular spacing, which is preferably equidistant to each other. Again, it is possible to arrange the several sound wave generators in other angular spacing with respect to each other, but the equiangular arrangement seems to provide for a higher overall signal amplitude.

The signal generator can comprise at least two sound wave generators distributed along the elongation axis of the elongated tubing such that each sound wave generator is able to amplify the torsional wave information signal. For example, the at least two sound wave generators can be activated synchronously in time and with the same phase, when—for example—the sound wave generators are arranged in a distance with respect to each other which corresponds to a multitude of wave lengths, or when they are arranged quite close to each other, e.g. neighbouring each other but not in the same perpendicular plane (perpendicular with respect to the elongation axis of the tubing). The two sound wave generators can be arranged in a distance to each other corresponding to e.g. a fraction of the wavelength, e.g. half the wave length, when the sound wave generators are activated synchronously, but with different point in phase of the information signal.

In accordance with the present disclosure there is also provided an information signal receiver for use in a downhole information transfer system, for example as explained above, and for receiving a torsional wave information signal which propagated along an elongated tubing. The information signal receiver comprises at least one transducer device designed for receiving said wave information signal, such as a torsional wave information signal, and for converting said received wave information signal. This transducer device is arranged at or near/close to the elongated tubing and extends perpendicularly with respect to the elongation axis of the tubing. In other words, the wave receiver or waver transceiver comprises a direction of wave reception (or wave emission), where the direction of wave reception is oriented perpendicular or more or less perpendicular with respect to the elongation axis of the elongated tubing. The direction of wave reception is thus not along the elongated tubing and not directed in the direction of the tubing, but the wave is detected/measured in a transverse direction to the elongation axis of the tubing. Additionally, the wave receiver may be positioned off-center, which is not in the center of the elongated tubing, but at or close to the side of the tubing, so that the wave is delivered tangentially to the elongated tubing. This setup may improve detection of waves, such as torsional waves. For example, it might even be possible to detect torsional waves when the wave receiver is oriented along the elongation axis of the elongated tubing.

The information signal receiver can alternatively or cumulatively comprise one or more magnetostrictive drivers.

The information signal receiver further comprises an outer shell, for example shaped elongated or tube-like so as to fit into a tubing, or a tubing of a wellbore.

The information signal receiver may further comprise at least a second transducer device arranged opposing the transducer device. Additionally or alternatively the transducer device or the second transducer device may comprise one or more soundwave receivers such as piezoelectric plates.

Further, the information signal receiver may comprise an inner transducer mounting device, where the at least one transducer device is mounted on the inner transducer mounting device facing towards the outer shell of the information signal receiver.

The at least one transducer device can each comprise an end mass between the at least one soundwave receiver and the outer shell, preferably in contact with the soundwave receiver on the one side and the inner side of the outer shell on the other side. In other words, the end mass can be designed such as to fill out the space lying in between the transducer device and the inner side of the outer shell. By this, a form-fit contact can be established between the soundwave receiver and the outer shell. When for example the outer shell constitutes part of the elongated tubing, then the transducer device is in direct contact with said elongated tubing, although it is not arranged directly at the side of the elongated tubing, but spaced apart by said end mass. In other words, in the case that the outer shell of the soundwave receiver is a pipe section of the elongated tubing, then the soundwave receiver can be installed inside the elongated tubing, which is arranged at the inner side of the tubing and surrounded an all sides by said elongated tubing, and should be brought in mechanical contact with said elongated tubing.

The information signal receiver may further comprise a battery compartment for storing electric energy, and additionally or alternatively an electronics compartment comprising an analog-to-digital converter.

The signal receiver can further have a coupling for mounting the information signal receiver to the elongated tubing. In other words, when the signal receiver comprises a pipe section, this pipe section can be coupled to the rest of the tubing by means of said coupling. Also it can be coupled to a consecutive compartment, e.g. comprising explosives, which is, a perforating gun.

The signal receiver preferably comprises a sensor device such as a depth correlator or a pressure sensor. The depth correlator can include a gamma ray to correlate gamma ray intensities to certain depth levels in the well bore. Also, a CCL (casing collar locator) could be used for depth correlation. The same can be achieved by means of a pressure and temperature sensors. The combination of the before-mentioned techniques can give a higher accuracy in depth measurement. However, it may be noted, that when the elongated tubing is constituted of tubing sections, the length of each section is known quite precisely, so that the depth of the signal receiver can also be obtained by measuring (or "counting") the number of pipe sections provided above the signal receiver unit and down in the well bore.

The at least one transducer device can comprise a stack of piezoelectric discs as the soundwave receiver. Such a stack of piezoelectric discs or plates is preferred as hereby the overall signal strength can be improved in both ways, receiving the signal as well as emitting any torsional wave information signal.

The information signal receiver thus is preferably designed as a transceiver capable of receiving and transmitting torsional waves over the elongated tubing with its soundwave receivers such as piezoelectric plates.

The transducer device of the signal receiver in a preferred embodiment is designed as to harvest energy from fluid movement of a wellbore fluid flowing through the elongated tubing. In other words, the fluid movement can impose movement of the transducer (the soundwave receiver), and when the transducer is moved, also an electrical current is generated. This electrical current and thus electrical energy could be stored or could be used to keep alive the electronics of the information signal receiver.

A further aspect of the present disclosure covers a perforating gun for use in downhole environment, for example for use with a downhole information transfer system as described above in detail. The perforating gun comprises at least the information signal receiver as described above.

The present disclosure is described in more detail hereinafter. Reference is made to the attached drawings wherein like numerals have been applied to like or similar components.

DETAILED DESCRIPTION

Figure 1:
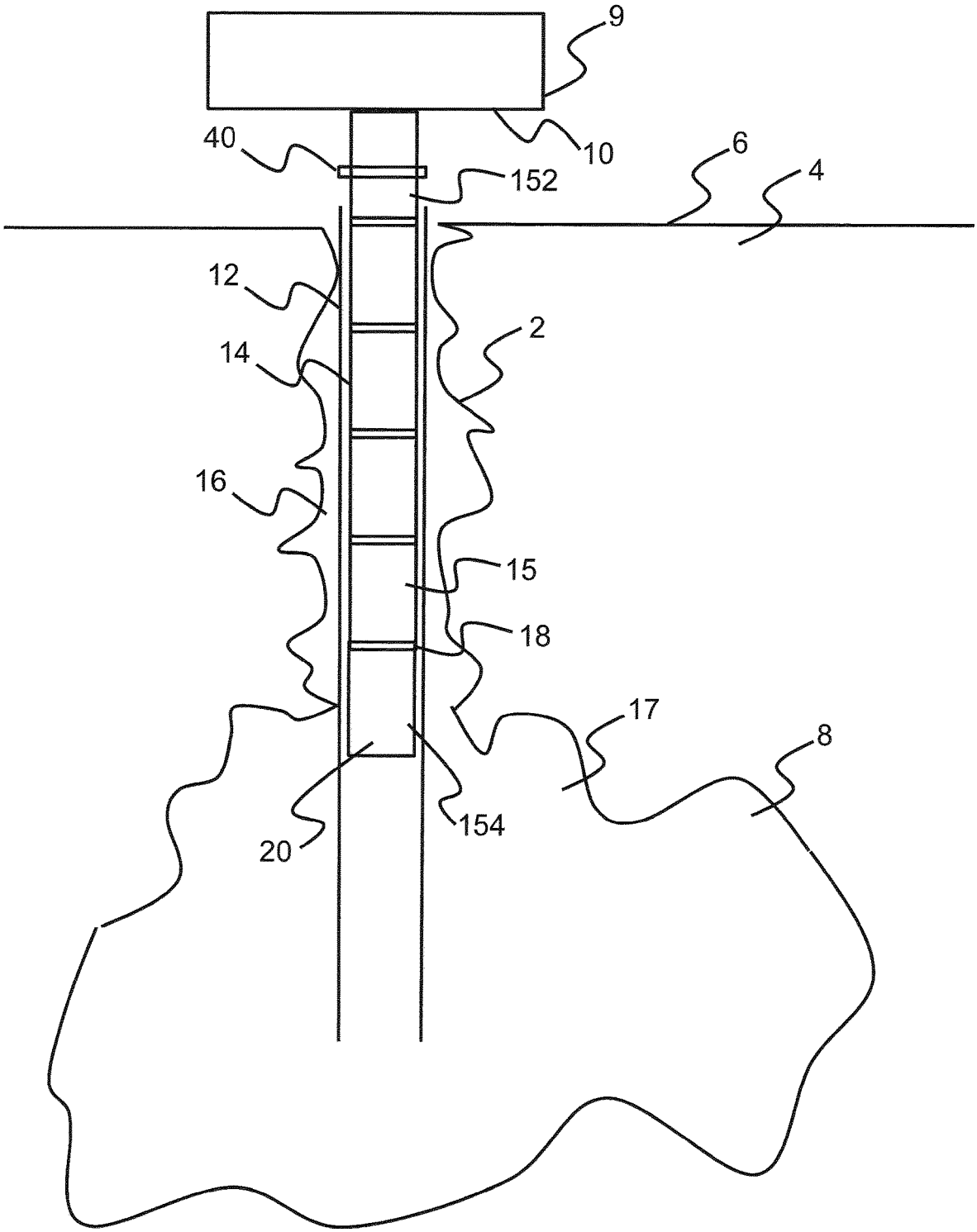
FIG. 1 a schematic cross-sectional view of an earth formation with a signal transmission system in a well (well bore)

In FIG. 1 a hole (well bore) 2 is drilled into an earth formation 4 to exploit natural resources like oil or gas. The well bore 2 continuously extends from the surface 6 to a reservoir 8. On top of the well bore a wellhead 10 is placed. The wellhead may include a "Christmas tree". The well is connected to an extraction facility 9.

A casing 12 in the form of an elongated steel pipe or steel tubing is located within the well bore 2 and extending from the surface near the wellhead 10 to an underground section of the well bore 2. Inside the casing 12 a tubing 14 is arranged comprising several pipe sections 15 each connected to the consecutive pipe section 15 by means of any sort of coupling 18, for example screw-type couplings. In this embodiment, the first pipe section 152 is connected with the wellhead 10 and is comprising the signal generator 40. The "lowest" or last pipe section 154 comprises the signal receiver 20. As the tubing 14 is used as propagation carrier for the information signal along the downhole and/or along the tubing 14, the information transfer system comprises the signal generator 40 at the wellhead, the tubing 14 as signal carrier and the downhole signal receiver 20. The well bore is typically filled with a wellbore fluid 16. The well bore fluid can vary widely.

The wellbore could consist of mud (drilling fluid), brine (completion fluid), injection fluids (steam, $CO_2$ or nitrogen) or fluids from the reservoir, such as water, oil and/or gas. These fluids may contain solids and deposits, such as sand particles, clay particles, scale deposits salts, barites, asphaltenes and polymers.

The tubing 14 thus typically only partly covers the well bore, as it is lowered just until the depth of interest, for example the depth in the wellbore where a perforating shall be undertaken, or where a valve shall be read out. The tubing 14 can be installed permanently in the well, or it can be lowered temporarily into the well, e.g. in the case of a planned perforation.

The signal receiver 20 is located in the well bore 2 as part of the tubing 14, thus comprising one pipe section 154 of the tubing 14. The signal receiver 20 operates autonomously having internal power storage 92 (see e.g. FIG. 6) and thus needs not be powered or wired externally. This eases installation and handling of the signal receiver 20, as no care has to be taken with respect to any wiring, and no limits have to be regarded with respect to depth of usage, which is total length of the tubing 14.

To sum up, the signal receiver 20 can be placed quite freely in the well bore 2 by means of adding pipe sections 15 to the tubing 14 between the first pipe section 152 and the last pipe section 154, whereby the signal receiver 20 is lowered into the well bore 2, and particularly needs not to be cable linked to the surface. It may be added, that the signal receiver 20 does not necessarily have to be installed to the last of the pipe sections 15, but other downhole means can be lowered farther down than the signal receiver 20, see e.g. FIG. 11 where a perforating gun 70 is mounted as the last pipe section 154, where the signal receiver 20 is installed above in another pipe section 15.

Figure 2:
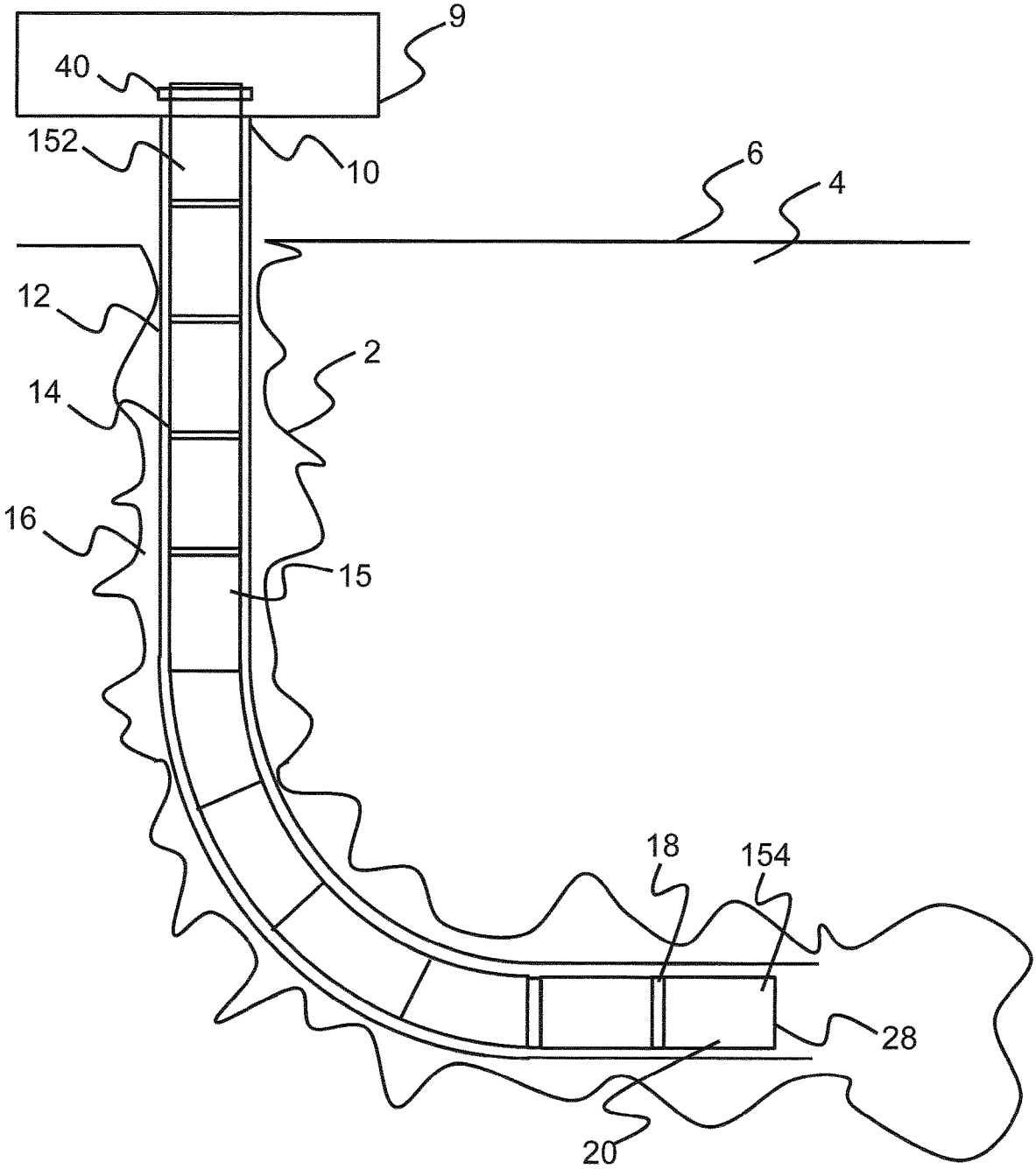
FIG. 2 another schematic cross-sectional view of an earth formation with a signal transmission system in a well bore having a horizontal section partly covered by a liner.

FIG. 2 shows another embodiment of an earth formation 2 with a signal receiver 20 positioned in a horizontal portion of the tubing 14. In this embodiment, the casing 12 as well as the tubing 14 ends in the well head 10. The signal generator 40 is arranged in or at the wellhead 10. The well 2 is drilled with an angle to the direction of production interest, in particular horizontally in the region of the last tube segment 154.

Figure 3:
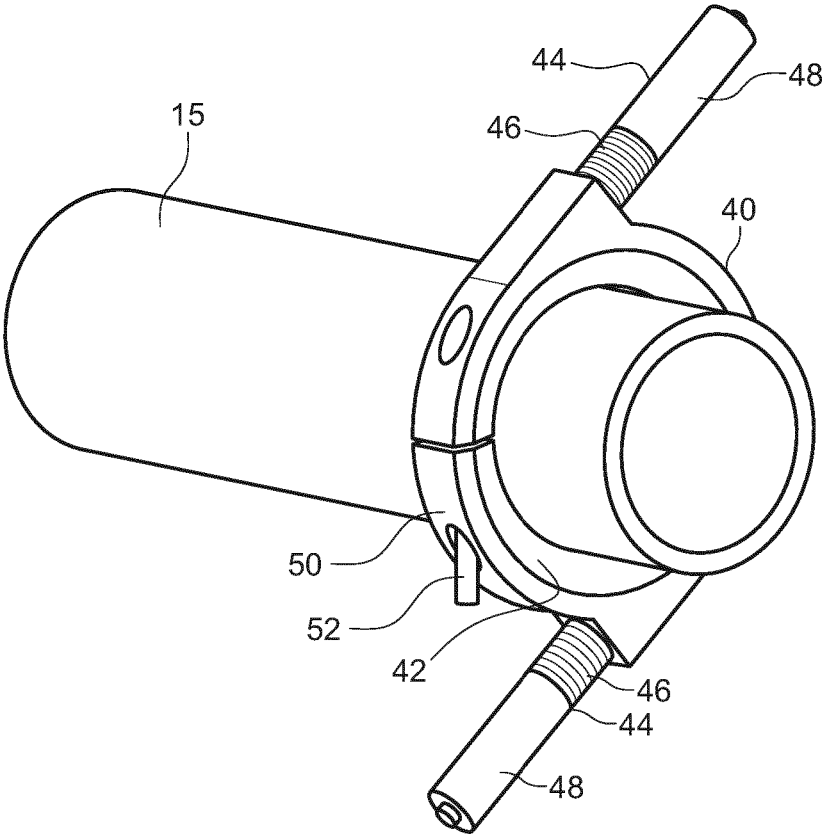
FIG. 3 a signal generator mounted on a tubing section, perspective view.

Turning to FIG. 3 an embodiment of a signal generator 40 is schematically shown mounted to a pipe section 15. The signal generator 40 comprises a circumferential portion 50 which is clamped to the pipe section 15 by means of fixation means 52. In order to further improve the contact pressure of the circumferential portion 50 on the pipe section 15, a constriction 42 is situated at the inner side of the circumferential portion 50. Two sound wave generators 44 are arranged on opposing sides of the pipe section 15, and are arranged perpendicular with respect to the elongation axis of the pipe section 15. The sound wave generators 44 can act a force on the circumferential portion, which in turn delivers this force to the pipe section 15, which starts a microscopic rotational movement in the pipe section 15. Thus, the sound wave generated by the sound wave generator 44 is converted into a torsional wave signal and imposed into the pipe section 15. The pipe section 15 then delivers the torsional wave signal along its extension and over any coupling 18 to the neighbouring pipe section 15, and thus along the elongated tubing 14 to the signal receiver 20.

Figure 4:
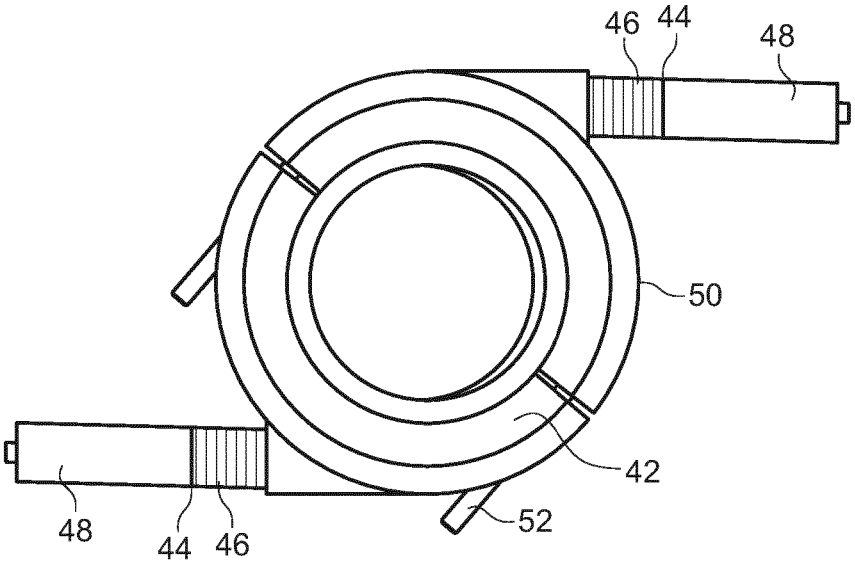
FIG. 4 a signal generator mounted on a tubing, top view.

FIG. 4 shows a top view on a pipe section 15 with a signal generator 40 mounted to it. The signal generator 40 has a circumferential portion 50 with a constriction 42 and two sound wave generators 44 opposing each other. Both sound wave generators 44 comprise a stack of several piezo discs 46 which together create the sound wave signal. The timing of the signal of the two sound wave generators 44 is done in such a way that both sound wave generator comprises the same signal phase, which then adds up to a total signal amplitude for stimulation of the torsional wave signal.

Figure 5:
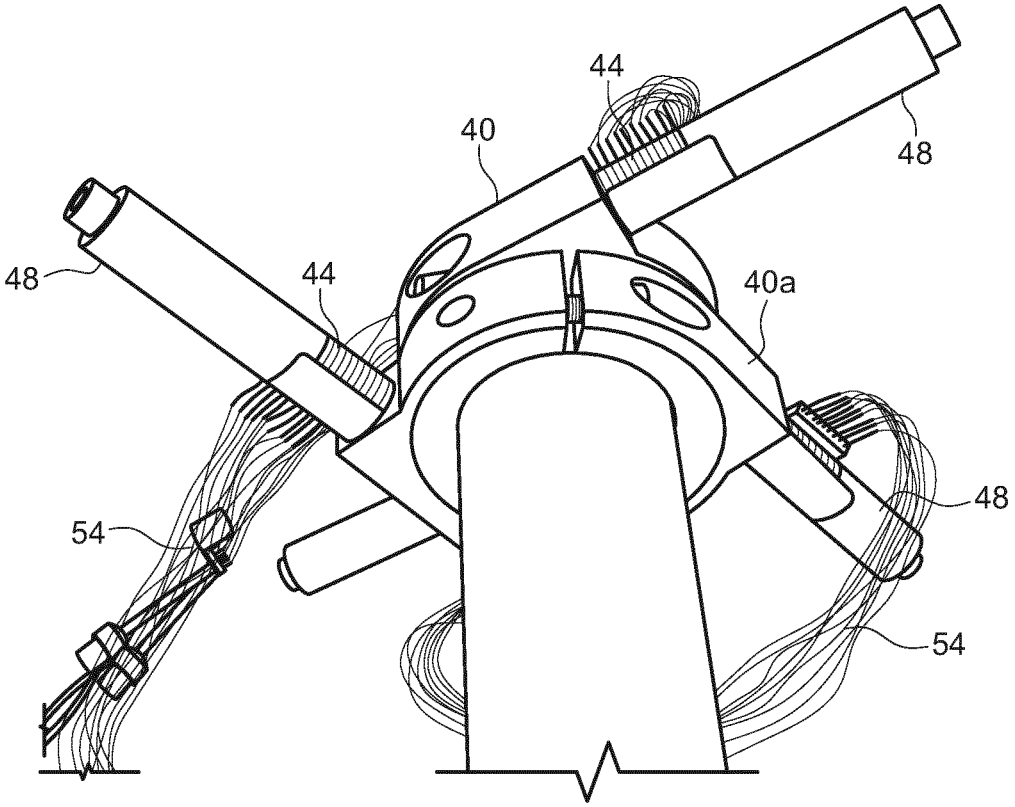
FIG. 5 photography of another signal generator mounted on a tubing.

FIG. 5 shows a perspective photography of an embodiment of a signal generator 40 mounted to a pipe section 15. This signal generator 40 comprises four sound wave generators 44 mounted more or less equiangular around the pipe section 15, and more or less perpendicular to the elongation axis of the pipe. The piezo discs 46 are connected by means of electrical connections 54 in order to deliver an electrical current to the piezo discs 46, so that the piezo discs 46 as transducers convert the electrical current into the sound signal. The sound waves generated by the sound wave generator 44 then are converted into a torsional wave information signal, which can propagate along the pipe section 15 from the first pipe section 152 to the last pipe element 154 where the signal receiver 20 is mounted to.

Figure 6:
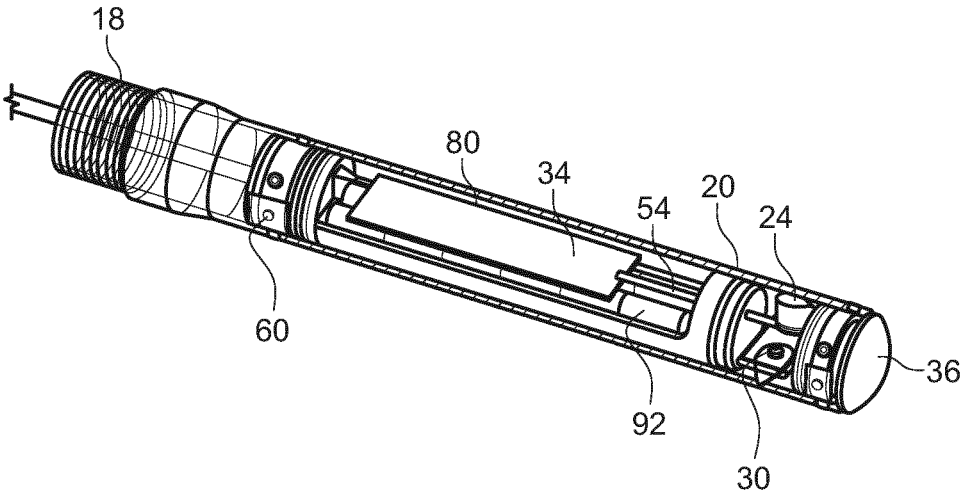
FIG. 6 perspective view of an embodiment of a signal receiving unit.

Referring now to FIG. 6 a schematic perspective view of an embodiment of a signal receiver 20 is shown, where the various technical installations can be seen inside the signal receiver 20, which is placed in the housing 28. The housing 28 is sketched partly transparent for clarity reasons. The signal receiver 20 is designed to be mountable or pairable with other pipe sections 15 of the elongated tubing.

In this embodiment, an end cap 36 is arranged on one side of the signal receiver 20, so that the signal receiving unit 20 may be mounted as the last pipe section 154, where other pipe sections 15 are connected to the signal receiving unit 20 by means of the coupling 18 arranged on the other side of the signal receiving unit 20. The signal receiver comprises a receiver 24 mounted on an inner transducer mounting device 30. The receiver 24 is wired by means of an electrical connection 54 to the electronics compartment 34, where for example an analog-to-digital converter and processing electronics may be situated. Further, a battery pack 92 is installed which provides electrical energy for operating the signal receiving unit 20.

The diameter of the housing 28 can be chosen e.g. with respect to the well bore diameter and/or the diameter of the tubing 14. The housing 28 may for instance have an outer diameter of 73 mm and an inner diameter of 55 mm, resulting in a housing thickness of about 18 mm. However, the outer diameter of the housing 28 lies preferably in a range in between 50 mm to 90 mm.

The signal receiving unit 20 further comprises a sensor 60, for example a pressure and temperature sensor and/or gamma ray detector, by means of which a depth in the well can be estimated. As an example in the embodiment, where the signal receiving unit 20 is placed to trigger an igniter of the perforating gun 70, the value measured from the pressure sensor 60 may be read out as a safety measure, where the receiving unit 20 can trigger the perforating gun 70. When the pressure is high enough the signal receiving unit 20 can trigger the igniter and the perforating guns 70 can be safely fired downhole. In summary, the signal receiver 20 is designed to receive the information signal comprising the activation signal for firing the perforating gun 70 sent by the signal generator 40 and the igniter can be triggered to fire the perforating gun 70.

Figure 7:
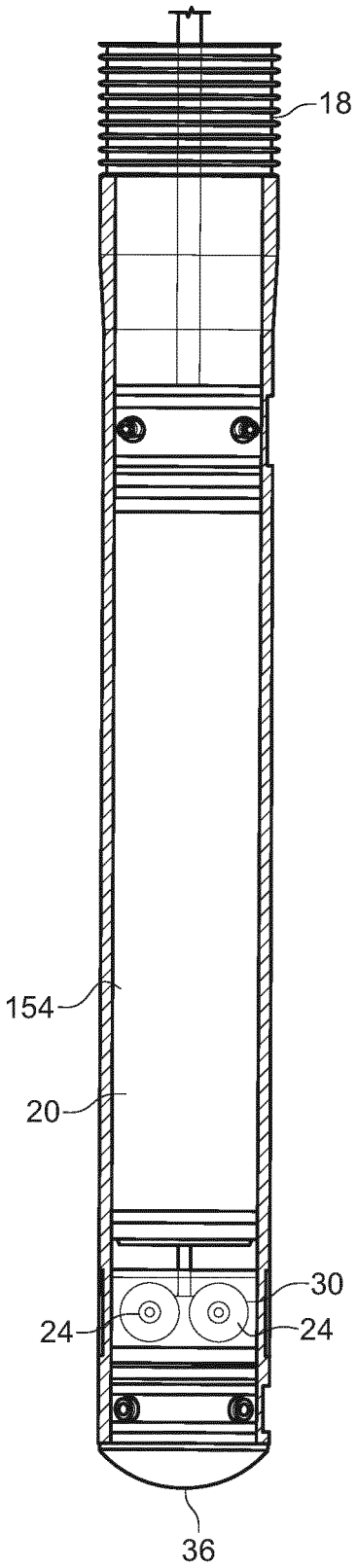
FIG. 7 side view of an embodiment of a signal receiving unit.

FIG. 7 shows a side view of a signal receiving unit 20, where again inner parts are made visible in the housing 28, which is partly sketched transparent. Two signal receivers 24 are mounted on an inner transducer mounting device 30, the mounting plate.

Figure 8:
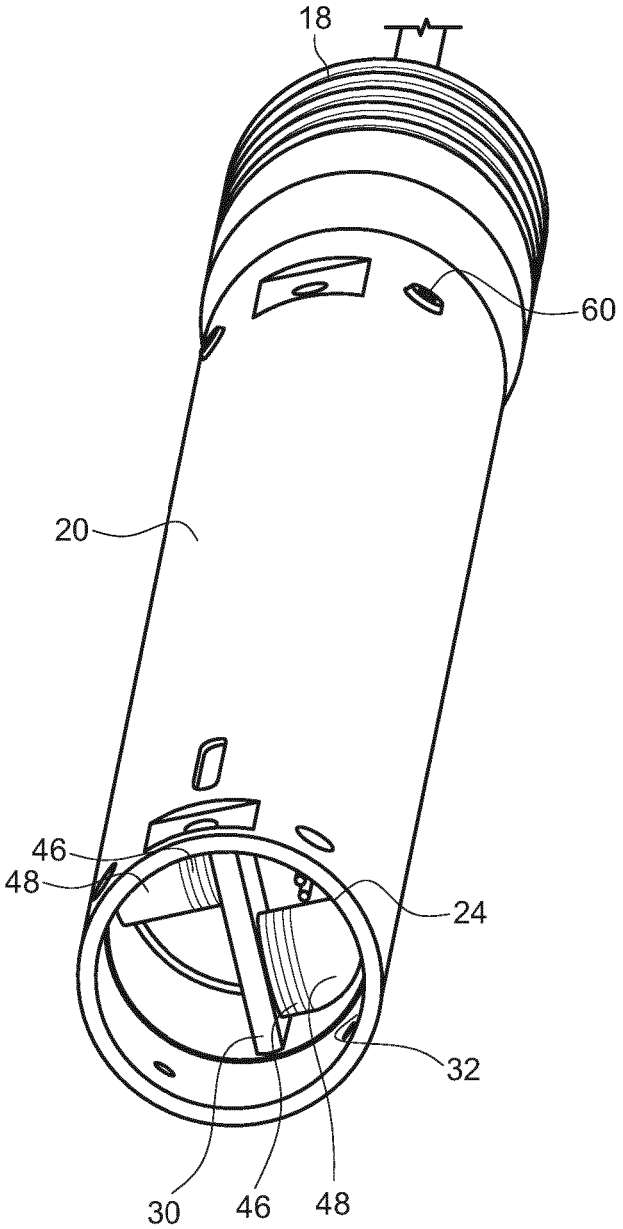
FIG. 8 perspective view of a partly opened signal receiving unit.

In FIG. 8 another perspective view of a partly opened signal receiving device 20 is shown. In this figure the installation of the two signal receivers 24 is visible. The two signal receivers 24 are mounted on the inner transducer mounting device 30 Each signal receiver 24 comprises a stack of piezoelectric discs 46 as well as an end mass 48. The end mass is arranged in between the piezo discs 46 and the inner side 32 of the housing 28 and is in physical contact with the inner side of the housing 28 on one side and with at least one of the piezo discs 46 and/or the stack of piezo discs on its other side. This arrangement allows for a sensitive and at the same time space-efficient installation of the signal receivers 24.

Figure 9:
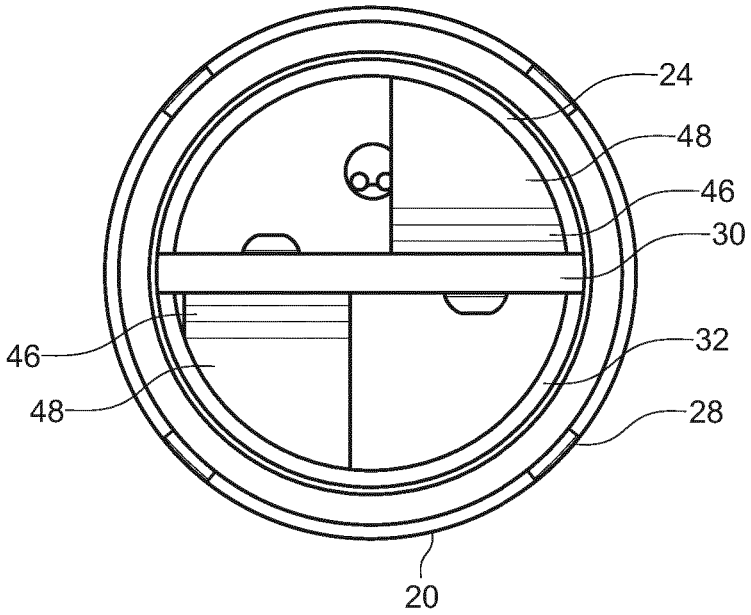
FIG. 9 top view of a partly opened signal receiving unit.

FIG. 9 shows a sectional view through a signal receiving unit 20. In FIG. 9 the arrangement of the two signal receivers 24 is shown. The two signal receivers are in physical contact with the inner side 32 of the housing 28 by means of the end mass 48, which is arranged on top of a stack of piezo discs 46, which in turn are mounted on the transducer mounting device 30. The whole setup allows for a conduction of the torsional wave information signal to the signal receivers 24 to improve the signal to noise ratio of the received information signal.

Figure 10:
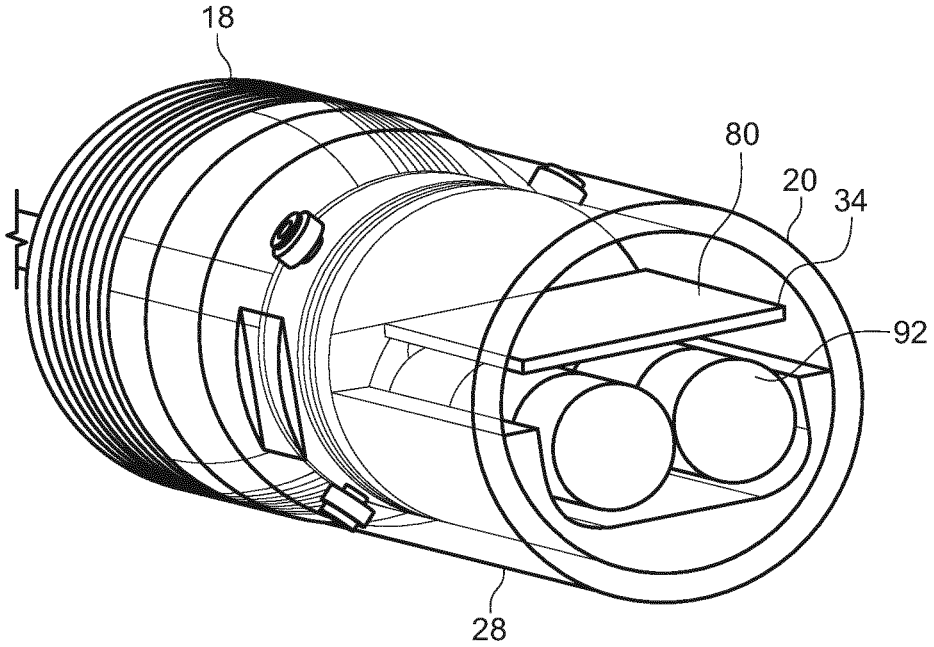
FIG. 10 another perspective view of a partly opened signal receiving unit.

In FIG. 10 a sectional perspective view of the electronics compartment 34 is shown, in which the battery pack 92 and some electronics 80 are installed, in this case a printed circuit board with some processing means.

Figure 11:
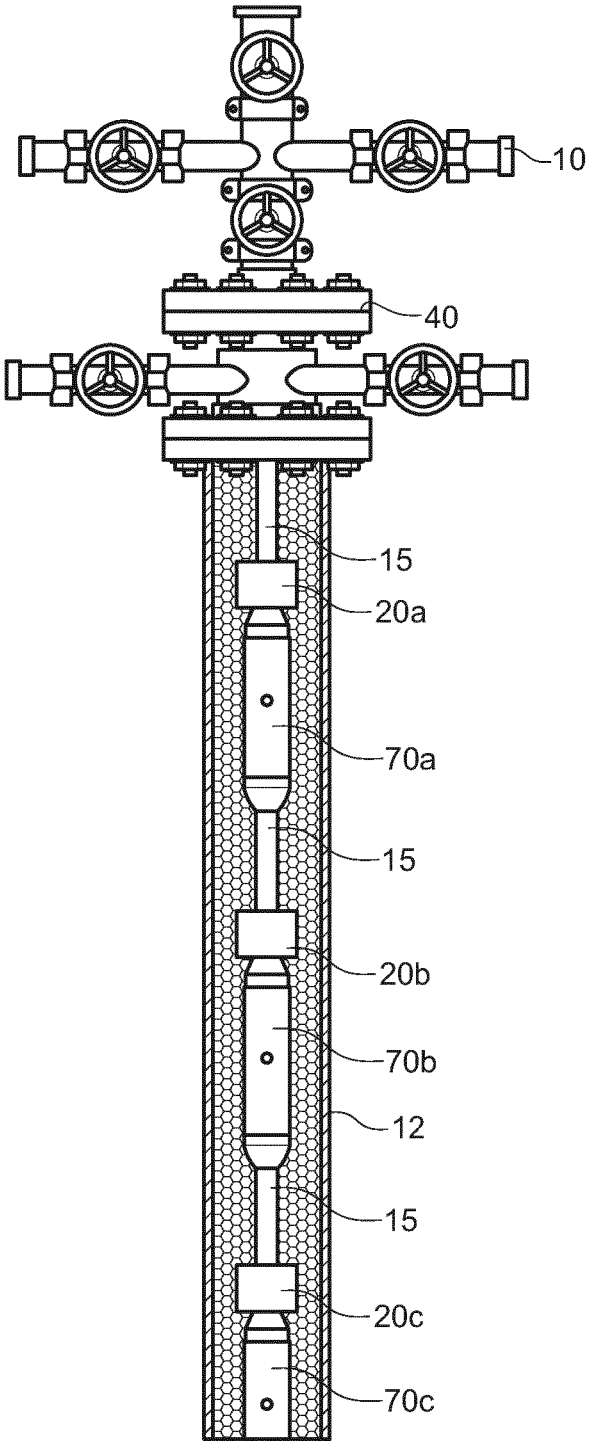
FIG. 11 side view of an embodiment for a downhole use of a signal transmission system with perforating guns.

FIG. 11 shows a setup for usage of the information transfer system as proposed herein. The signal generator 40 is installed near or at the wellhead 10, and one or several pipe sections 15 are arranged below the wellhead to the first signal receiving unit 20*a* installed below. The first receiving unit 20*a* is situated in the wellbore, for example several hundred meters or even several thousand meters down below the opening of the well bore, which is typically at surface.

Next to the first signal receiving unit 20*a* an igniter and perforating gun 70*a* is installed. The igniter and perforating gun 70*a* can be placed directly below the first signal receiving unit 20*a*. It can for example also be wire connected to the first signal receiving unit 20*a*, which is placed some ten or some hundred meters from the perforating gun. This setup might be chosen e.g. when the signal receiving units must be spaced at some distance from the detonation zones, which will be generated when the perforating guns are fired.

One or several further pipe sections 15 connect this perforating gun 70*a* with the second signal receiving unit 20*b*, which is installed next to a second perforating gun 70*b*. Another pipe section 15 is connected to the second perforating gun 70*b* with a third signal receiving unit 20*c* connected to a third perforating gun 70*c* and so forth. For example, ten perforating guns 70 could be run in the wellbore at the same time in this manner—and be fired one after another in only one run. By this, the tubing 14 needs only to be put in place in the well once for performing all necessary perforations in the well.

When the perforating guns 70, 70*a*, 70*b*, 70*c* are being fired, the first information signal is delivered to the last receiving unit. In the example of FIG. 11 this is the third receiving unit 20*c*. The information signal can comprise an encoded trigger signal for firing the third perforating gun 70*c*. The other signal receiving units 20*a* and 20*b* may receive this signal, but can be programmed not to trigger the perforating gun(s) associated to them. Additionally, or alternatively, the other signal receiving units 20*a* and 20*b* can be programmed to repeat or amplify the received trigger signal addressed to the third receiving unit 20*c*. Thus, the receiving units 20*a* and 20*b* can act as repeaters in the elongated tubing 15. When the third signal receiver 20*c* triggers the third perforating gun 70*c* it may be possible, that the third receiving unit 20*c* is no longer reachable due to malfunction or destruction. Due to this, the lowest perforating gun 70*c* should be fired first, and thereafter the proximate next perforating gun 70*b*, and finally 70*a*.

In other words, the present disclosure allows for firing of several perforating guns by an individual command for each gun. All of this can be done by only one downhole run instead of several runs. This will reduce the time required for perforating and therefore will result in less production deferment and consequently in additional revenues. The presented information transfer system also allows for safe information delivery over long distances, where wired communication is undesirable, or difficult, or even impossible due to high deviation of the wellbore. Furthermore, run of high/long cable lengths may lead to wire failures and is not necessary any longer.

It will be appreciated that the features defined herein in accordance with any aspect of the present disclosure or in relation to any specific embodiment of the disclosure may be utilized, either alone or in combination with any other feature or aspect of the disclosure or embodiments. In particular, the present disclosure is intended to cover an information signal delivery system to include any feature described herein, and a signal generator, an information signal receiver and a perforating gun. It will be generally appreciated that any feature disclosed herein may be an feature of the present disclosure alone, even if disclosed in combination with other features, irrespective of whether disclosed in the description, the claims and/or the drawings.

It will be further appreciated that the above-described embodiments of the present disclosure have been set forth solely by way of example and illustration of the principles thereof and that further modifications and alterations may be made therein without thereby departing from the scope of the disclosure.

What is claimed:

1. A wireless downhole information transfer system, comprising:

an elongated tubing having several tubing sections, comprising a first and a last end tubing section, an information signal generator arranged on the outside of the elongated tubing and at or near the first end tubing section of the elongated tubing and designed as a torsional wave generator for transmission of a torsional wave information signal along the elongated tubing, wherein the information signal generator comprises at least one sound wave generator arranged transverse with respect to an elongation axis of the elongated tubing for generation of said torsional wave information signal, said torsional wave information signal emitted in a direction transverse to the elongation, an information signal receiver arranged at or near the end tubing section of the elongated tubing, wherein the elongated tubing between the information signal generator and the information signal receiver constitutes a carrier for transmission of the torsional wave information signal between the information signal generator and the information signal receiver.

2. The wireless downhole information transfer system according to claim 1, wherein the torsional wave information signal is provided in the form of a trigger and/or a short pulse signal, and/or wherein the torsional wave information signal can be coded to provide information to distinguishable receivers and/or to provide distinguishable information.

3. The wireless downhole information transfer system according to claim 1, wherein the information signal generator is a transceiver, and/or the information signal receiver is a transceiver.

4. The wireless downhole information transfer system according to claim 1, wherein the torsional wave information signal is provided in form of a resonant frequency adapted to the properties of the elongated tubing, and/or adapted to the total distance between the information signal generator and the information signal receiver.

5. The wireless downhole information transfer system according to claim 1, further comprising one or more further information signal receivers arranged along or near the elongated tubing.

6. The wireless downhole information transfer system according to claim 1, wherein the information signal generator comprises at least one piezoelectric driver.

7. The wireless downhole information transfer system according to claim 6, wherein the piezoelectric driver comprises one or more piezoelectric discs stacked in a line, and/or wherein the information signal generator comprises two or more piezoelectric drivers, the two or more piezoelectric drivers arranged on opposing sides of an elongation axis of the elongated tubing and/or arranged symmetrically or equiangular around the elongation axis of the elongated tubing.

8. The wireless downhole information transfer system according to claim 1, wherein the torsional wave information signal comprises a frequency in the range of 2 to 20 kHz.

9. The wireless downhole information transfer system according to claim 1, further comprising at least one repeater arranged between the information signal generator and the information signal receiver, and/or comprising one or more further information signal receivers arranged along or near the elongated tubing wherein at least one of the one or more further information signal receivers is a repeater configured to pass the torsional wave information signal to the next repeater and/or to the information signal receiver arranged at or near the end section of the elongated tubing.

10. The wireless downhole information transfer system according to claim 9, wherein each repeater is designed to use a distinguishable coding, and/or wherein for each 1500 meters or more of elongation of the elongated tubing an additional repeater is used to amplify the torsional wave information signal.

11. The wireless downhole information transfer system according to claim 1, wherein the information signal receiver includes a processing means to provide autocorrelation of the received information signal to improve signal recognition.

12. The wireless downhole information transfer system according to claim 1, wherein both the signal generator and the signal receiver are transceivers and wherein a frequency range is tested and at least one resonance frequency is acknowledged by at least one of the signal generator and the signal receiver to provide autotuning capability.

13. The wireless downhole information transfer system according to claim 1, wherein the information signal receiver is connected with one or more perforating units in a well bore, where the torsional wave information signal comprises a firing signal for detonation of a firing unit of one or more of the perforating units.

14. The wireless downhole information transfer system according to claim 1, wherein the elongated tubing is made of metal.

15. The wireless downhole information transfer system according to claim 1, wherein the information signal receiver comprises an energy storage in order to provide electric energy to the information signal receiver.

16. A perforating gun for use with the wireless downhole information transfer system of claim 1, the perforating gun comprising an information signal receiver comprising at least one transducer device configured for receiving said torsional wave information signal and for converting said received torsional wave information signal, the transducer device being arranged at or near the elongated tubing and extending perpendicularly with respect to the elongation axis of the tubing, and an outer shell of the information signal receiver, the outer shell having an elongated or tube-like shape so as to fit into a wellbore or the elongated tubing.

* * * * *